US005375304A

United States Patent [19]

Miyauchi et al.

[11] Patent Number: 5,375,304

[45] Date of Patent: Dec. 27, 1994

[54] AUTOMATIC BUCKLING DEVICE

[75] Inventors: Kiyotaka Miyauchi; Tetsuya Hamaue, both of Shiga, Japan

[73] Assignee: Takata Corporation, Tokyo, Japan

[21] Appl. No.: 183,611

[22] Filed: Jan. 18, 1994

[30] Foreign Application Priority Data

Jan. 27, 1993 [JP] Japan ..... 5-11544

[51] Int. Cl.[5] ..... A44B 11/26

[52] U.S. Cl. ..... 24/603; 24/627; 24/633

[58] Field of Search ..... 24/603, 633, 635, 642, 24/627

[56] References Cited

U.S. PATENT DOCUMENTS

| | | | |
|---|---|---|---|
| 1,635,144 | 7/1927 | Stevens, Jr. | 24/603 X |
| 4,149,300 | 4/1979 | Eaton | 24/603 X |
| 5,274,890 | 1/1994 | Shimizu et al. | 24/603 |

*Primary Examiner*—James R. Brittain
*Attorney, Agent, or Firm*—Kanesaka & Takeuchi

[57] ABSTRACT

An automatic buckling device comprising a tongue attached to a seat belt and a buckle for latching the tongue. The tongue includes a cover case, a tongue plate which can project from the forward end of the cover case, a spring for urging the tongue plate in the direction in which the tongue plate is withdrawn into the cover case, and a recessed portion provided on the surface of the tongue plate at the forward end thereof so as to engage a ball. The buckle includes an insertion passage into which the tongue is inserted, a solenoid for drawing the tongue plate into the buckle, a ball which is engageable with the recessed portion of the tongue plate which is inserted into the insertion passage, a ball holder for holding only a part of the ball so that the ball can enter the insertion passage, a ball stopper which moves to a latch-holding position at which the ball stopper comes into close contact with the ball when a part of the ball enters the insertion passage so as to check the withdrawal of the ball from the insertion passage, and a stopper moving mechanism for moving the ball stopper to the latch-holding position when the tongue plate has completely entered the insertion passage and moving ball stopper from the latch-holding position by remote switching control in order to separate the tongue from the buckle.

5 Claims, 16 Drawing Sheets

AUTOMATIC BUCKLING DEVICE

BACKGROUND OF THE INVENTION

1. Field of the Invention

The present invention relates to an improvement of a mechanism for connecting a tongue and a buckle of a seat belt apparatus which is installed in vehicles or the like and, more particularly, to an automatic buckling device for automatically connecting the tongue with the buckle when the tongue is brought close to the buckle.

2. Description of the Related Art

When an occupant uses a seat belt apparatus installed in an automobile, a tongue having a ring portion at the forward end thereof through which the seat belt is run is manually inserted into a buckle.

Since the buckle is disposed on one side of a seat, the occupant must twist the upper half of his body in an uncomfortable posture in order to insert the tongue into the buckle.

OBJECT AND SUMMARY OF THE INVENTION

Accordingly, it is an object of the present invention to eliminate the above-described problems in the related art and to provide an automatic buckling device which enables a tongue to automatically insert into a buckle by utilizing a motor or the like.

To achieve this aim, in a first aspect of the present invention, there is provided an automatic buckling device having a mechanism of drawing a tongue plate into a buckle by a solenoid, fitting balls into the recessed portions provided in the tongue plate so as to check the withdrawal of the tongue plate, thereby latch-holding the tongue plate.

In an automatic buckling device provided in a second aspect of the present invention, the operation of inserting the tongue plate and the operation of latching the balls are conducted in series through an ejector pin. In an automatic buckling device provided in a third aspect of the present invention, the latching mechanism is composed of a ratchet wheel and a stopper portion for stopping the rotation of the ratchet wheel. In an automatic buckling device provided in a fourth aspect of the present invention, the mechanism for rotating the ratchet wheel is composed of a guide wall.

In an automatic buckling device provided in the first aspect of the present invention, when the forward end portion of the tongue plate enters the insertion passable, the solenoid is excited so as to draw the tongue plate into the insertion passage. When the tongue plate is drawn into the insertion passage deep enough, the balls are fitted in the recessed portions of the tongue plate and a ball stopper is moved to the latch-holding position at which the ball contacting portion comes into close contact with the balls so as to check the withdrawal of the balls, thereby latch-holding the tongue plate.

When the ball stopper is moved from this latch-holding position, the balls are withdrawn and the tongue plate is released from latch-holding. The tongue plate is then pushed out of the insertion passage by the force of a spring.

In an automatic buckling device provided in the second aspect of the present invention, when the tongue plate advances in the insertion passage, the tongue plate pushes the ejector pin. With the movement of the ejector pin, the ball stopper is moved in the direction of latch-holding.

The ejector pin is stopped in the middle of the movement. When the ejector pin is stopped, the ball stopper is also stopped at the latch-holding position.

In an automatic buckling device provided in the third aspect of the present invention, the attitude of the ratchet wheel is serially changed by the repetition of the advance and the withdrawal of the ejector pin, and with the change of the attitude of the ratchet wheel, the ejector pin and the ball stopper are advanced or withdrawn.

In an automatic buckling device provided in the fourth aspect of the present invention, the attitude of the ratchet wheel is changed by engaging a notched portion of the ratchet wheel with a protrusion at the intersection of a guide wall and a first ratchet wheel rotation stopping wall. The attitude of the ratchet wheel is also changed by bringing the forward end of the ratchet wheel in the course of movement into close contact with a second ratchet wheel rotation stopping wall.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
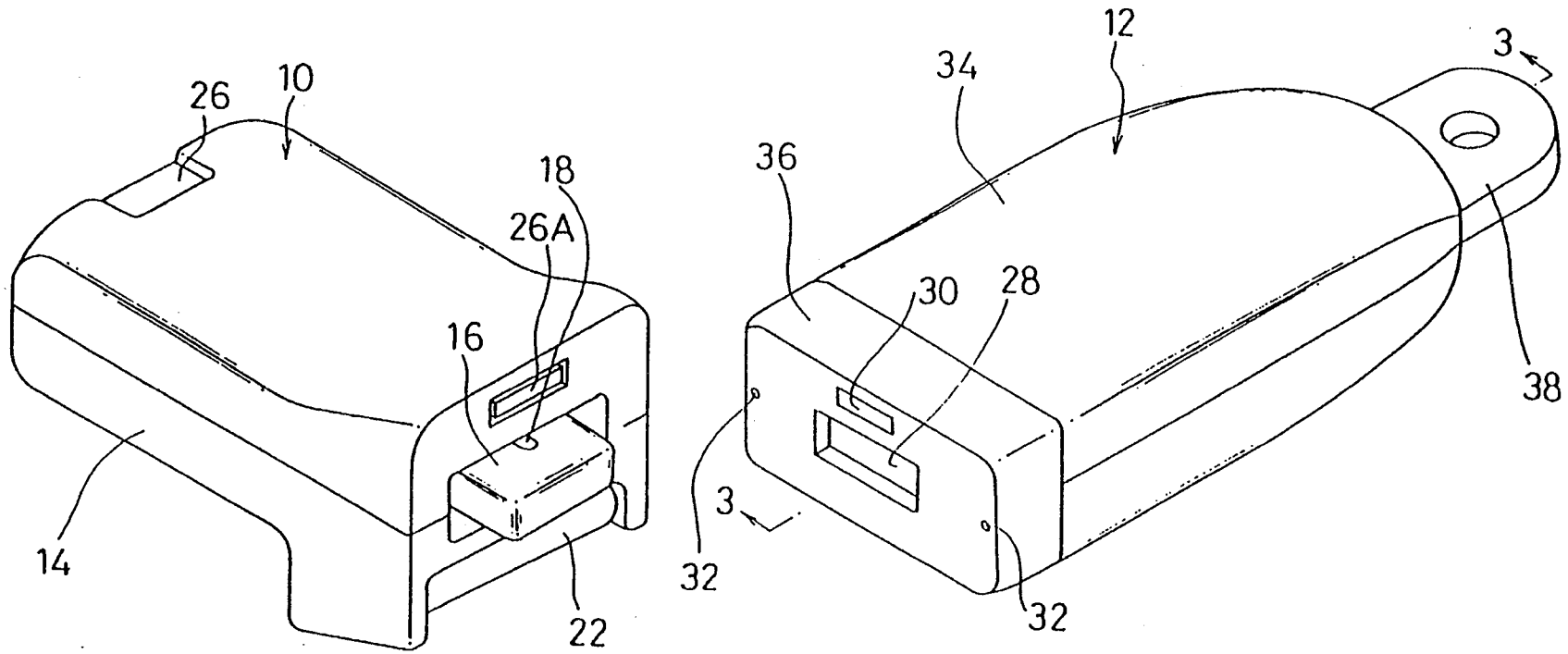
FIG. 1 is a perspective external view of the entire part of an embodiment of an automatic buckling device according to the present invention.
Figure 2:
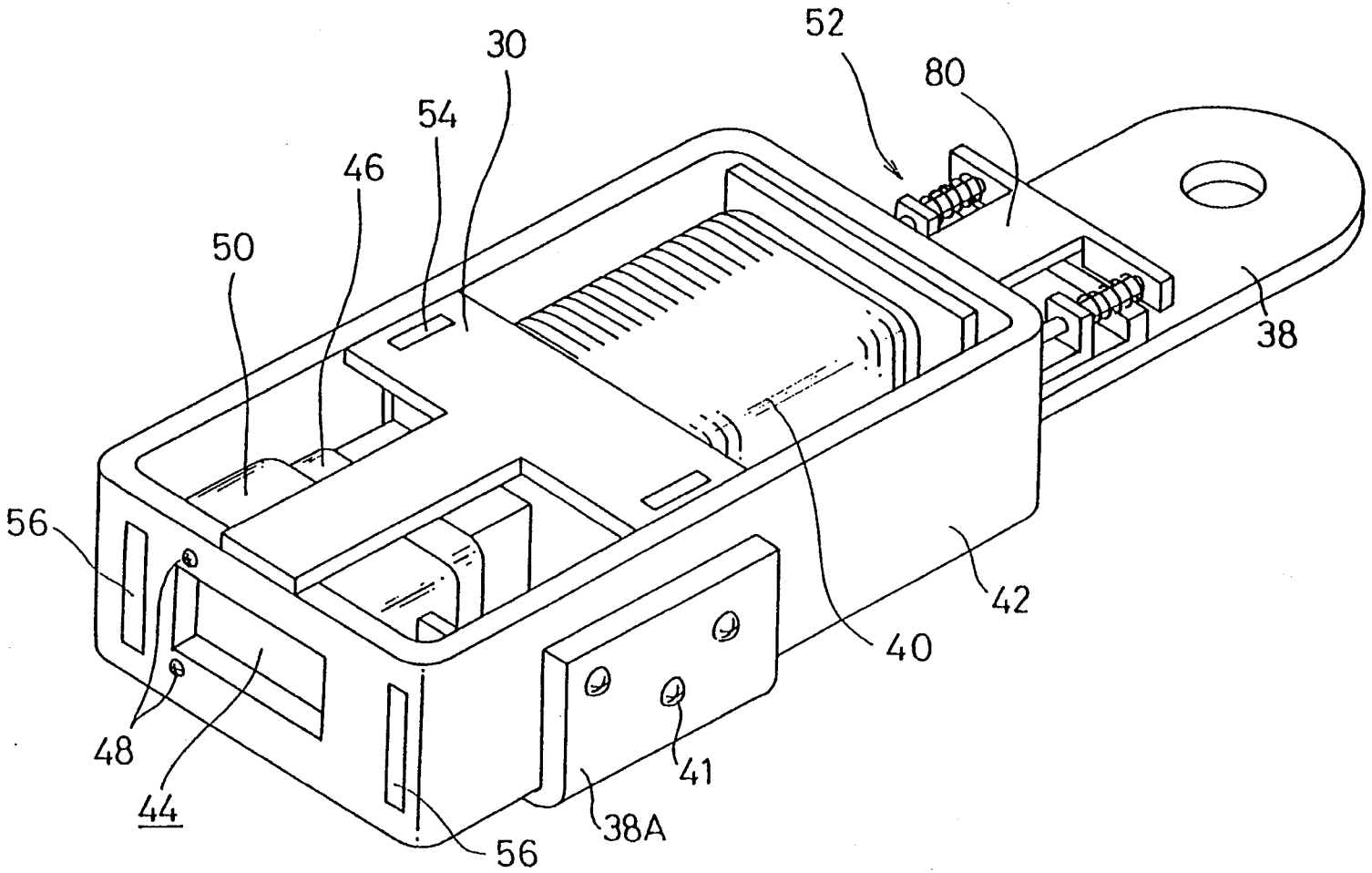
FIG. 2 is a perspective view of the internal structure of the buckle in the embodiment shown in FIG. 1, with the covers removed therefrom.
Figure 3:
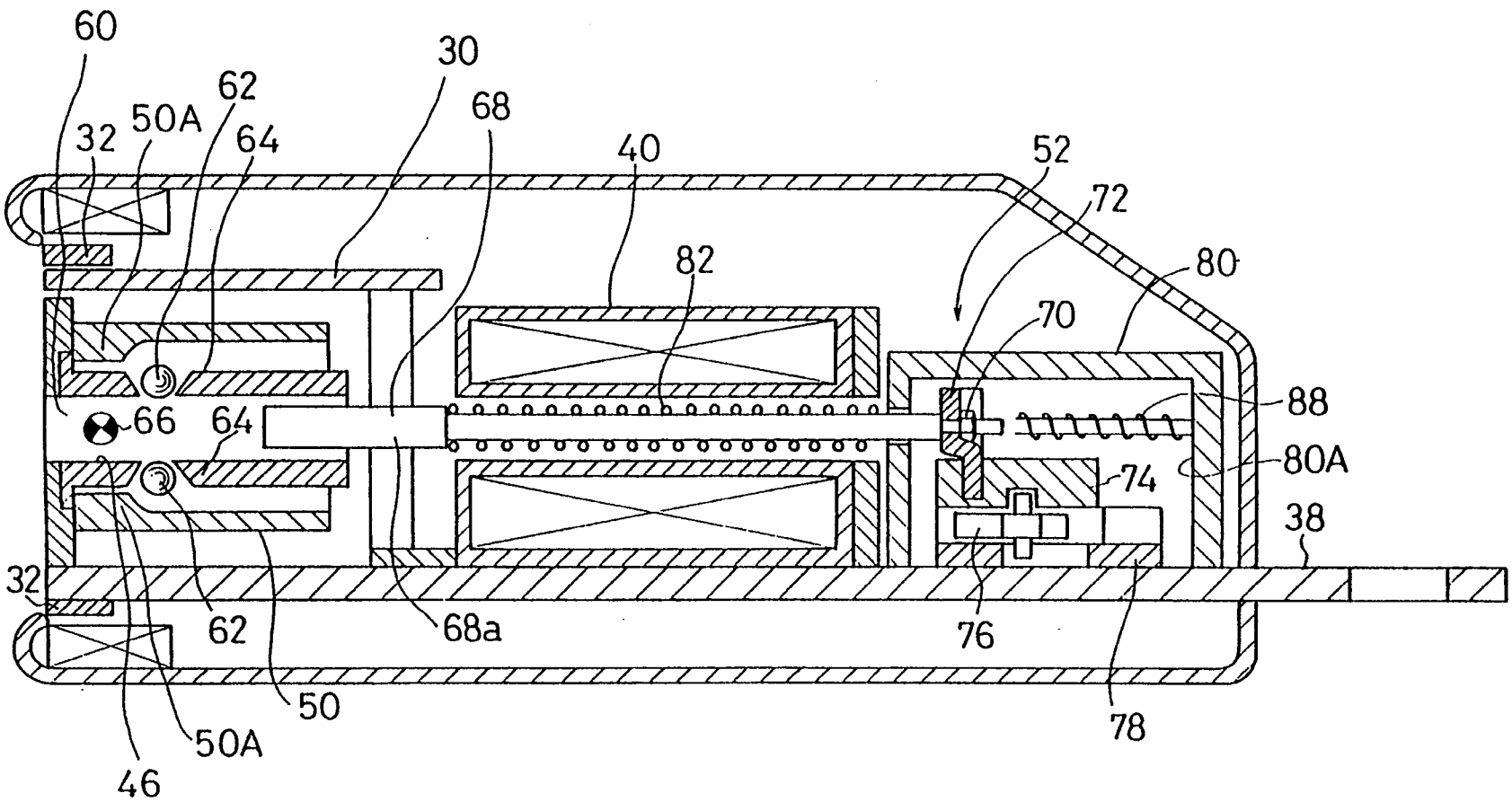
FIG. 3 is a sectional view of the embodiment shown in FIG. 1, taken along the line 3—3.
Figure 4:
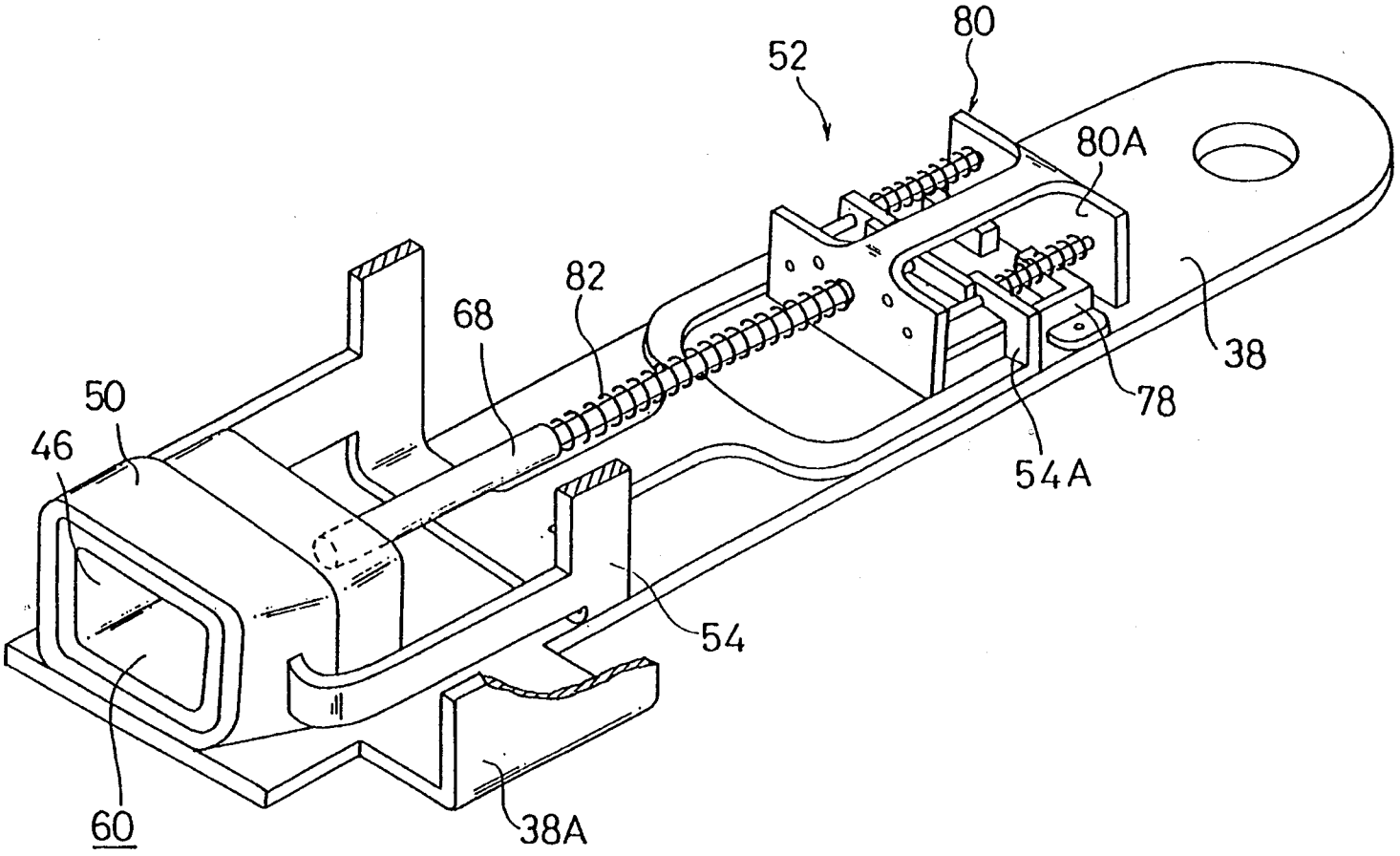
FIG. 4 is a perspective view of the internal structure of the buckle shown in FIG. 2 with the yoke and the solenoid removed therefrom.
Figure 5:
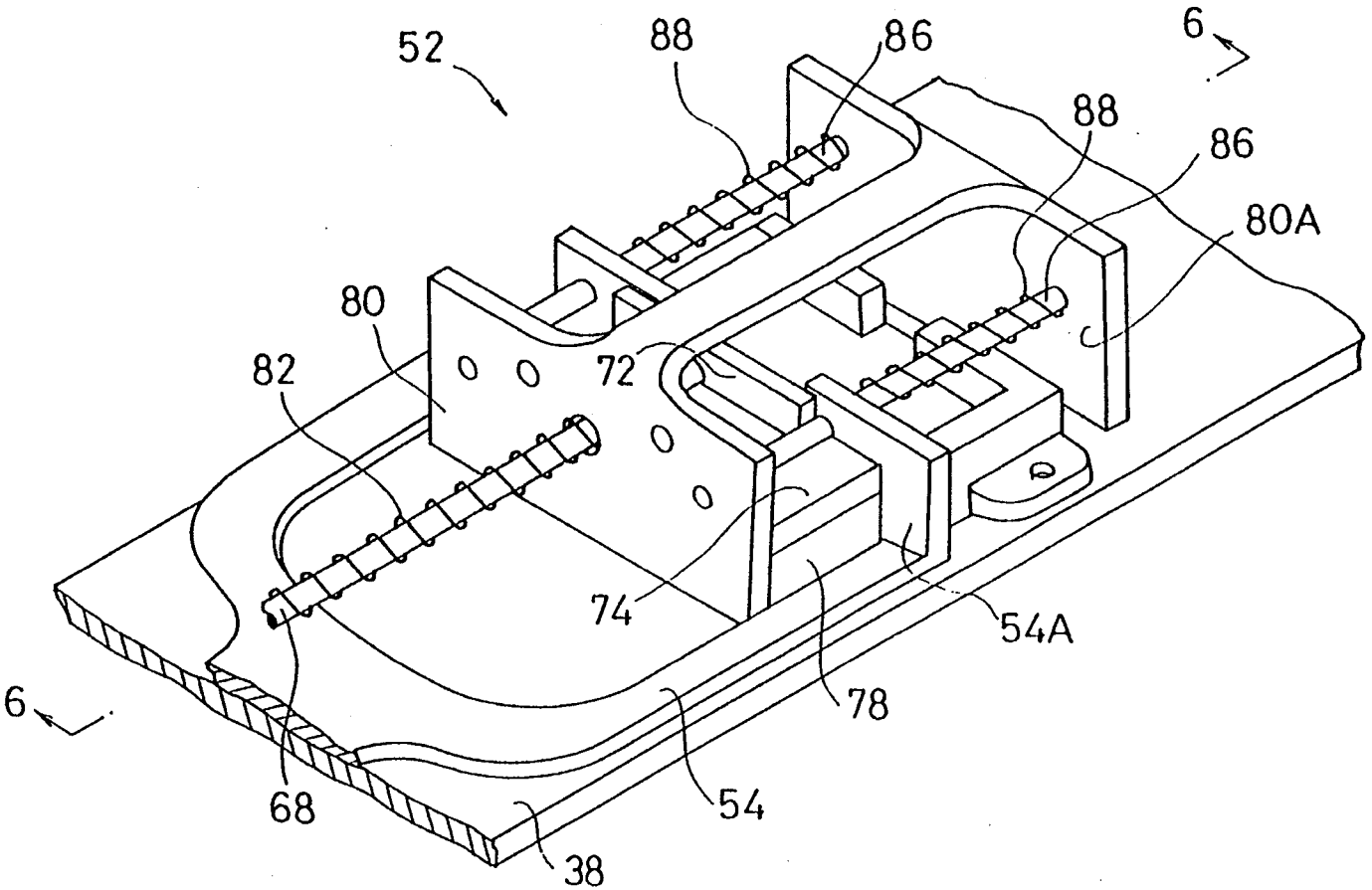
FIG. 5 is an enlarged view of the main part of the buckle shown in FIG. 4.
Figure 6:
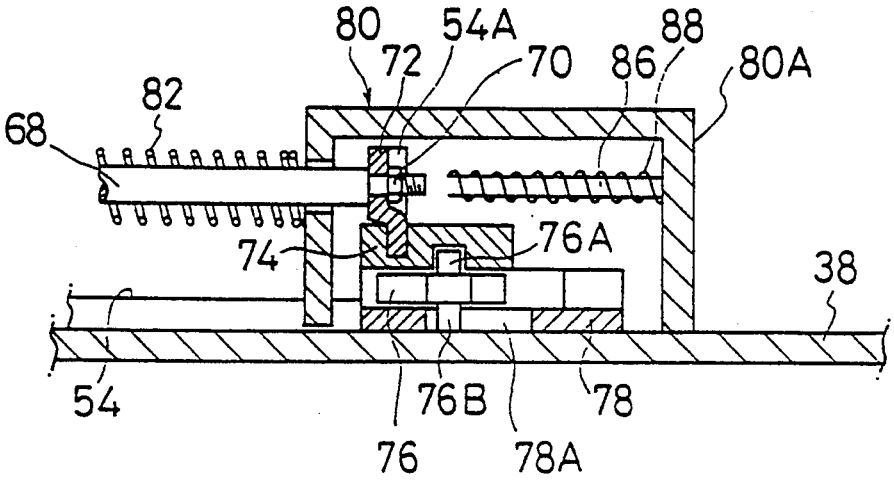
FIG. 6 is a sectional view of the main part of the buckle shown in FIG. 5, taken along the line 6—6.
Figure 7:
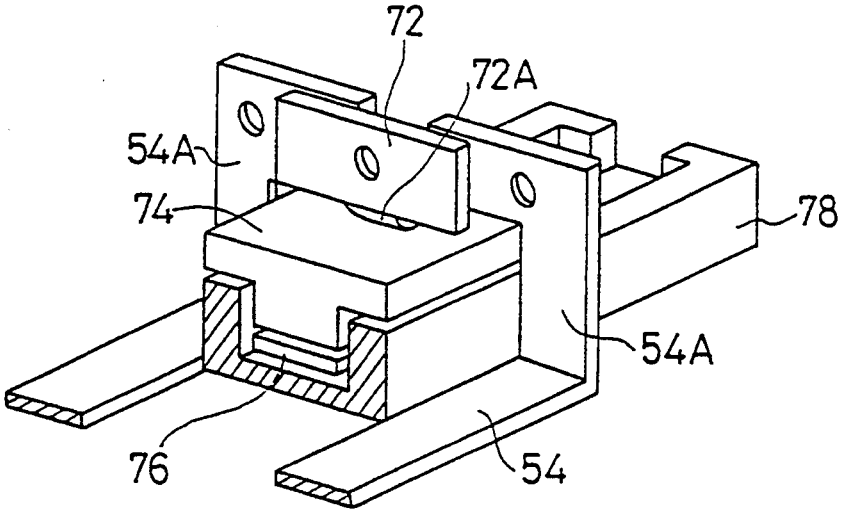
FIG. 7 is a perspective view of the stopping mechanism shown in FIG. 3 in the state of being engaged with the rear part of the link.
Figure 8:
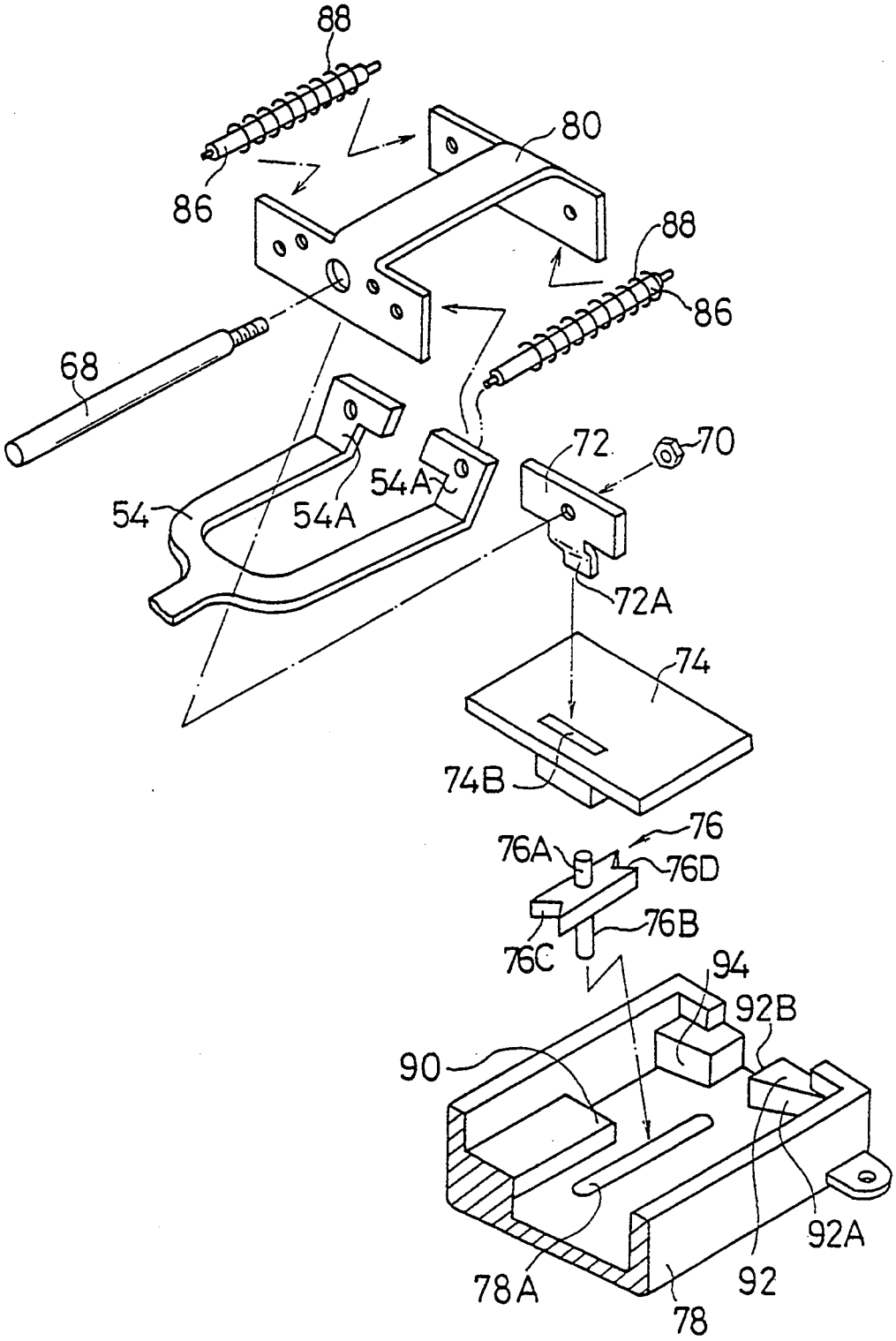
FIG. 8 is an exploded perspective view of the structure of the stopping mechanism shown in FIG. 7.
Figure 9:
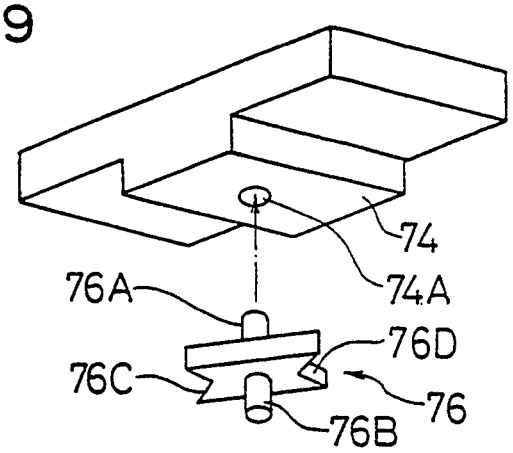
FIG. 9 explains the engagement of the slider with the ratchet wheel shown in FIG. 6.
Figure 10:
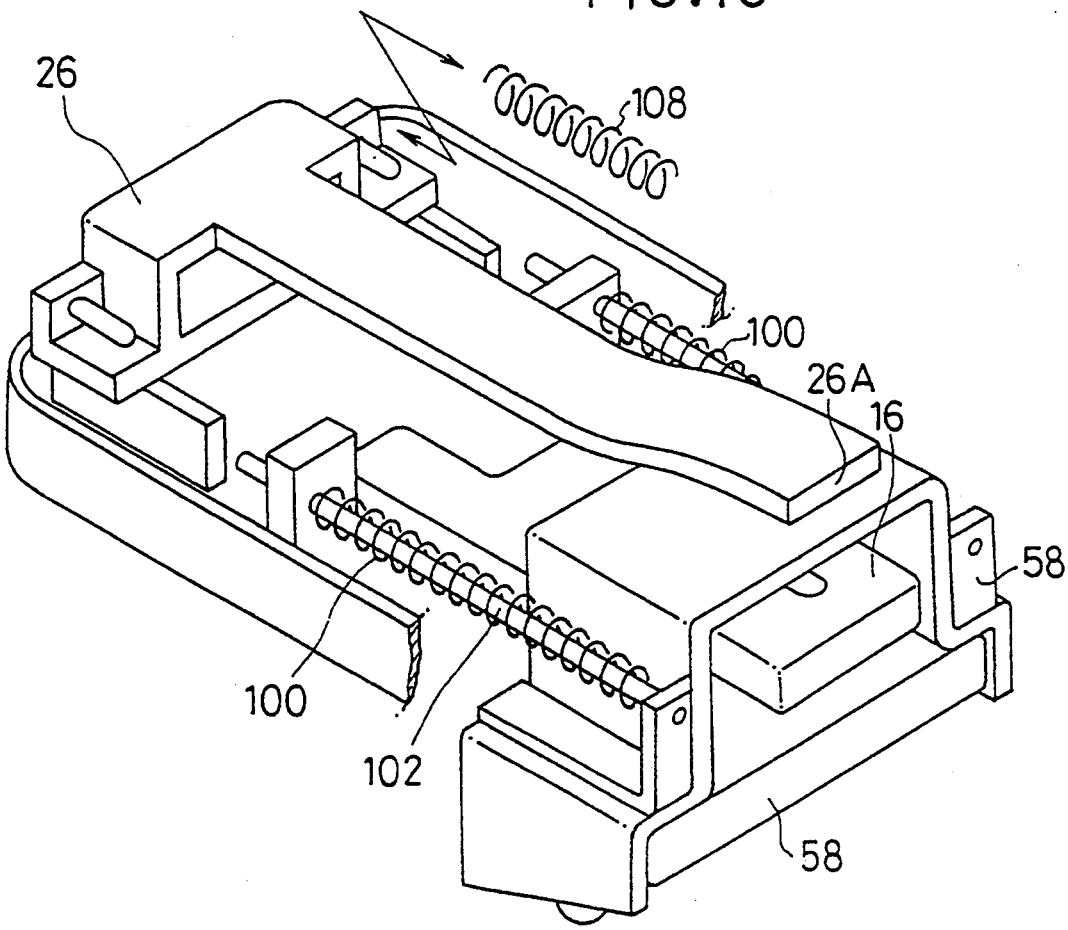
FIG. 10 is a perspective view of the internal structure of the tongue in the embodiment shown in FIG. 1.
Figure 11:
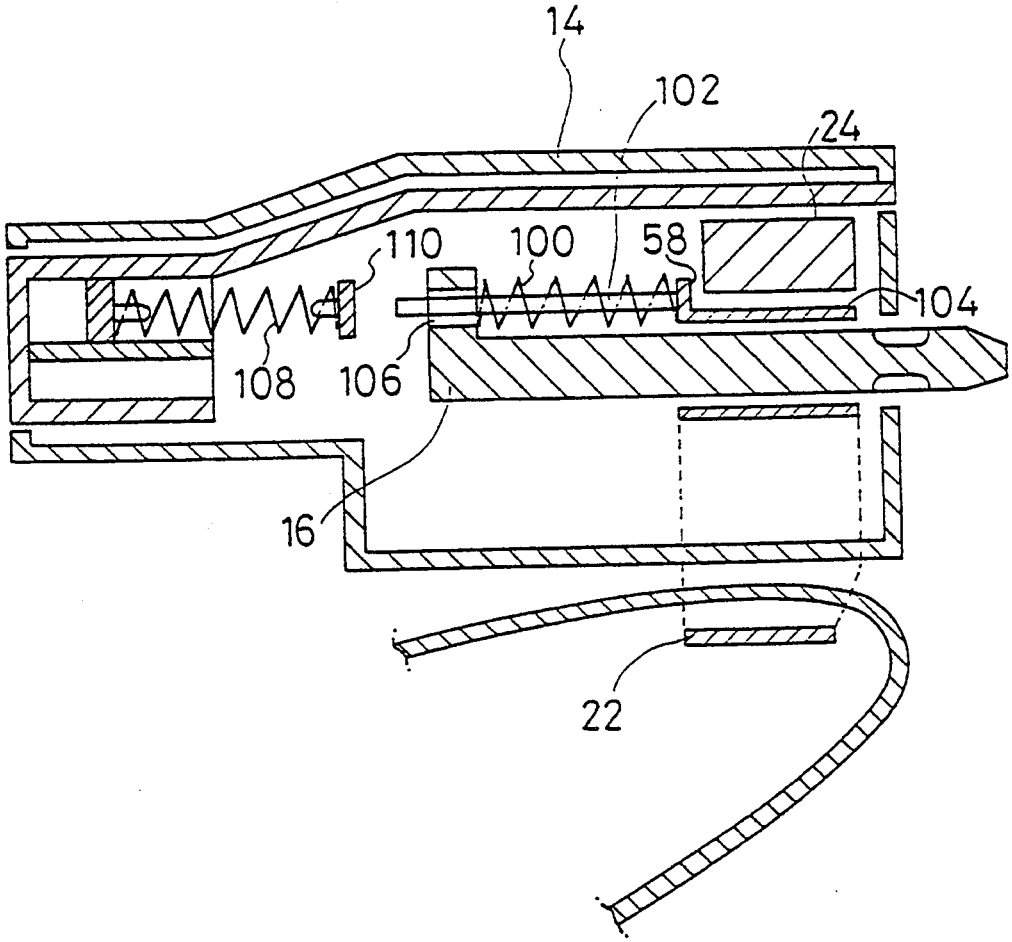
FIG. 11 is a vertical sectional view of the tongue shown in FIG. 11.
Figures 16A, 16B:
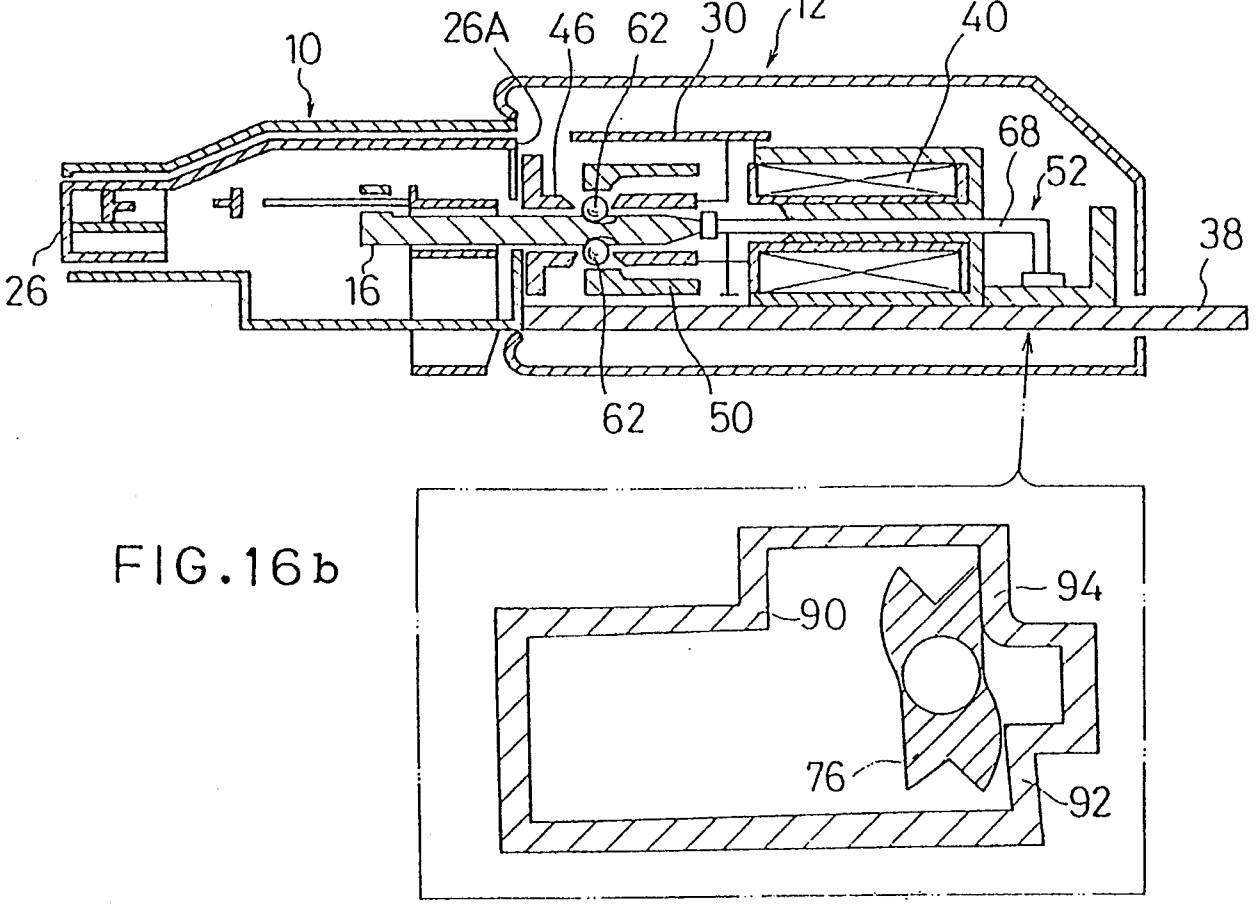
FIG. 16 is a sectional view of the tongue and the buckle, showing the step (1) of separating the tongue from the buckle.
Figures 17A, 17B:
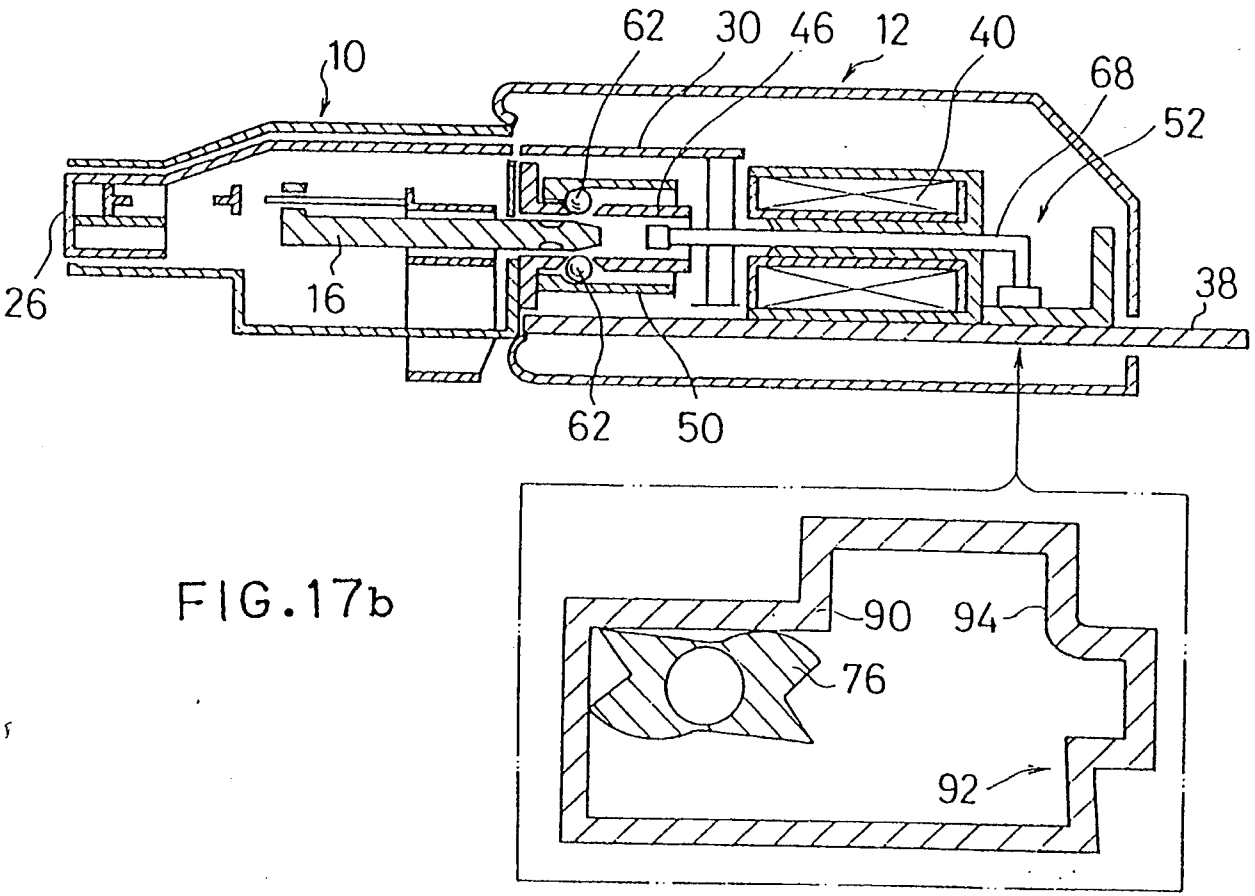
FIG. 17 is a sectional view of the tongue and the buckle, showing the step (2) of separating the tongue from the buckle.
Figure 18:
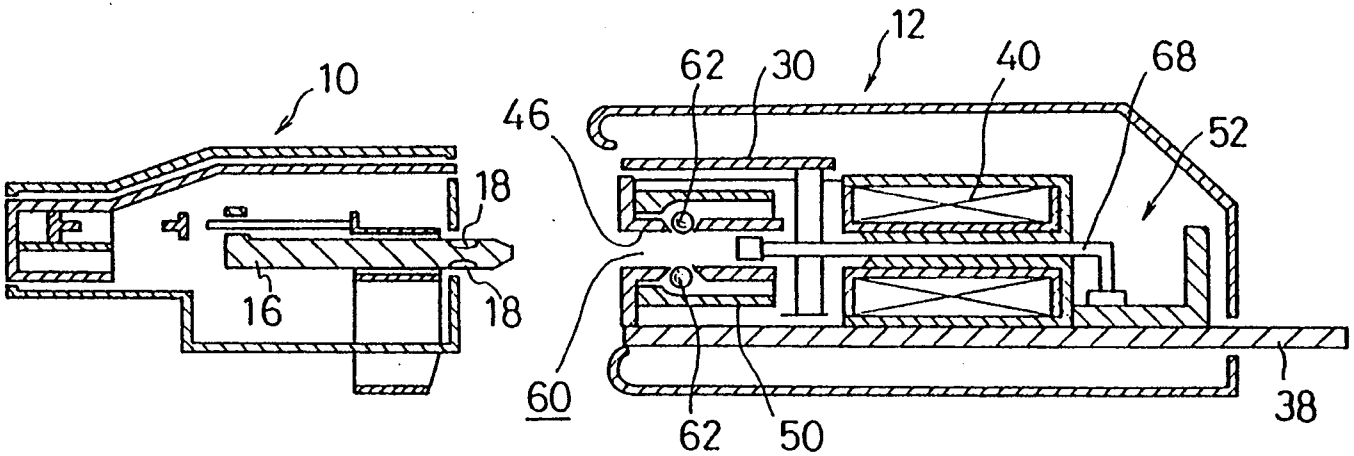
FIG. 18 is a sectional view of the tongue and the buckle, showing the step (3) of separating the tongue from the buckle.

An embodiment of an automatic buckling device according to the present invention will be explained hereinunder with reference to the accompanying drawings. FIG. 1 is a perspective view of the entire part of an embodiment of an automatic buckling device according to the present invention; FIG. 2 is a perspective view of the internal structure of the buckle with the covers removed therefrom; FIG. 3 is a sectional view of the embodiment shown in FIG. 1, taken along the line 3—3; FIG. 4 is an enlarged perspective view of the main part of the buckle with the cover and the solenoid removed therefrom; FIG. 5 is an enlarged perspective view of the structure of the main part of the buckle shown in FIG. 4; FIG. 6 is a sectional view of main part of the buckle shown in FIG. 5, taken along the line 6—6; FIG. 7 is a schematic perspective view of the stopping mechanism; FIG. 8 is an exploded perspective view of the structure of the stopping mechanism; FIG. 9 is an exploded perspective view of the ratchet wheel and the slider, explaining the engagement thereof; FIG. 10 is a perspective view of the internal structure of the tongue; FIG. 11 is a vertical sectional view of the tongue; FIGS. 12 to 15 are vertical sectional views of the tongue and the buckle, showing the steps of engaging the tongue with the buckle; and FIGS. 16 to 18 are vertical sectional views of the tongue and the buckle, showing the steps of separating the tongue from the buckle.

Referring first to FIG. 1, an embodiment of an automatic buckling device according to the present invention is composed of a tongue 10 and a buckle 12. The tongue 10 is provided with a tongue plate 16 inserted into a tongue cover 14. The tongue plate 16 can project from the forward end surface of the tongue cover 14. As shown in FIG. 1, a recessed portion 18 which engages with a later-described ball is provided on both surfaces of the tongue plate 16. The tongue cover 14 is provided with a plate 22 for holding a belt 20. In place of the plate 22, a roller may be used. As shown in FIG. 11, an iron piece or a magnet 24 is provided on the forward end surface of the tongue 10. A release button 26 for manually withdrawing a push plate 30 is exposed at the rear end portion of the tongue 10.

In the buckle 12, an entrance 28 for passing the tongue plate 16 therethrough is provided on the joint surface which engages with the tongue 10. The push plate 30 which comes into contact with the forward end 26A of the release button 26 when the tongue 10 is engaged with the buckle 12 extends to the joint surface. A photoelectric switch 32 for detecting the approach of the tongue 10 is also provided on the joint surface. The buckle 12 is covered with covers 34 and 36, and a base 38 is inserted there between.

As shown in FIG. 2, the buckle 12 is provided therein with a solenoid 40 for drawing the tongue plate 16 into the buckle 12 and operating a latch mechanism which will be described later. A yoke 42 for causing the magnetic flux of the solenoid 40 to flow is also provided in the buckle 12. The yoke 42 is attached to a U-shaped bracket 38A erected sideward on the base 38 by screws 41.

An inlet 44 for passing the tongue plate 16 therethrough is provided on the forward end surface of the yoke 42. A sleeve-shaped ball holder 46 is fixed to the inner surface of the yoke by screws 48 in such a manner that the opening 64 thereof communicates with the inlet 44. A ball stopper 50 is placed over the ball holder 46. The ball stopper 50 is advanced or withdrawn by the solenoid 40 and a stopping mechanism 52 which will be described in detail in the following.

The ball stopper 50 is connected to the stopping mechanism 52 through a link 54, as shown in FIG. 4. The push plate 30 is connected to the link 54 so that the ball stopper 50 can be manually advanced or withdrawn.

As shown in FIG. 2, a small solenoid 56 is provided on the forward end surface of the yoke 42. The solenoid 56 attracts an iron plate 58 (see FIG. 10) disposed on the forward surface of the tongue 10, thereby attracting the tongue 10 to the buckle 12.

The interior of the ball holder 46 constitutes the insertion passage 60 for the tongue plate 16, and balls 62 are movably provided in apertures 64 of the ball holder 46 so as to face the insertion passage 60, as is clear from FIG. 3. The aperture 64 has an inner diameter slightly smaller than the ball 62 so that only a part of the ball 62 enters the insertion passage 60 and, hence, fits in the recessed portion 18 of the tongue plate 16.

When the balls 62 are fitted in the recessed portions 18, the ball contacting portion 50A of the ball stopper 50 is situated at the latch-holding position at which the ball contacting portion 50A comes into close contact with the balls 62 so as to check the withdrawal of the balls 62 from the insertion passage 60. A limit switch 66 for detecting the entrance of the tongue plate 16 is disposed in the insertion passage 60.

The distal end portion of an ejector pin 68 is inserted into the depth of the insertion passage 60. The ejector pin 68 is passed through the center opening of the solenoid 40 and the proximal end portion thereof is inserted into the stopping mechanism 52. The stopping mechanism 52 is composed of a fixed plate 72 which is fixed to the proximal end of the ejector pin 68 by a nut 70, a slider 74 which moves with the movement of the fixed plate 72, a ratchet wheel 76 which is moved by the slider 74, a case 78 for guiding the ratchet wheel 76, a spring holder 80, etc.

A return spring 82 is disposed between the spring holder 80 and the stepped portion 68*a* (in FIG. 3) in the middle of the ejector pin 68. The ejector pin 68 is urged leftward (seen in FIG. 3) by the return spring 82.

As shown in FIGS. 4 and 5, the rear end of the link 54 is turned up so as to form the rear portion 54A which faces the fixed plate 72, and the rear portion 54A is engaged with the fixed plate 72. Guide rods 86 which extend in parallel with the ejector pin 68 are pierced through the rear end portion 54A. The proximal ends of the guide rod 86 are fixed to the vertical wall 80A of the spring holder 80, and a return spring 88 is fitted over the guide rod 86 between the vertical wall 80A and the rear end portion 54A.

Referring to FIGS. 6, 8 and 9, the ratchet wheel 76 is composed of a main body with rotary shafts 76A and 76B projected at the center thereof. Notched portions 76C and 76D are provided on both shorter sides of the main body. The rotary shaft 76B is slidably inserted into a guide groove 78A provided in the case 78, and the rotary shaft 76A is rotatably inserted into a bearing hole 74A provided in the under surface of the slider 74.

A ratchet wheel stopper portion 90 which engages the notched portions 76C and 76D is provided on the bottom surface of the case 78 beside the guide groove 78A at a middle of the length of the guide groove 78A. Attitude changing portions 92 and 94 for changing the attitude of the ratchet wheel 76 are also provided on the bottom surface of the case 78.

Figures 12A, 12B:
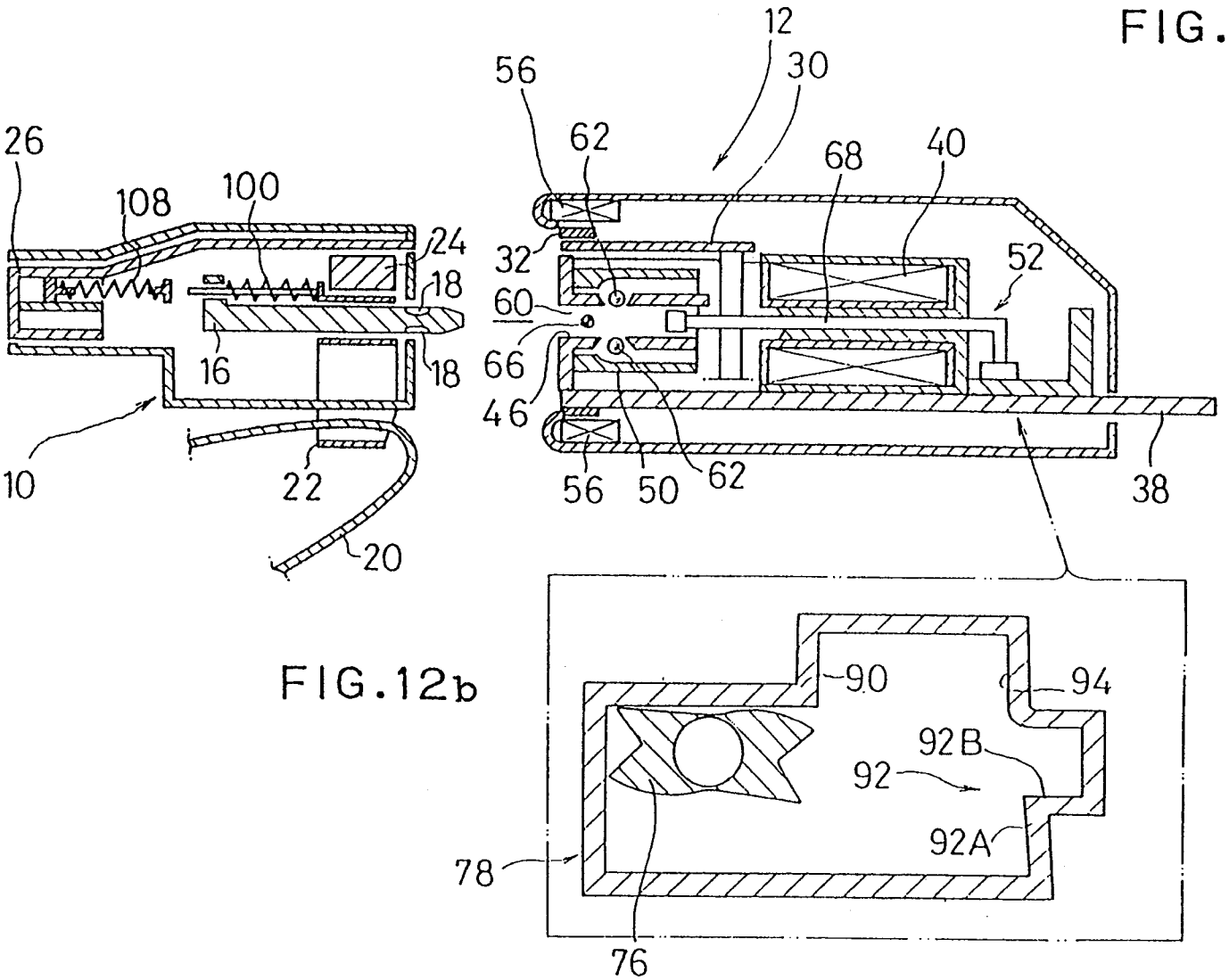
FIG. 12 is a sectional view of the tongue and the buckle, showing the step (1) of engaging the tongue with the buckle.
Figures 14A, 14B:
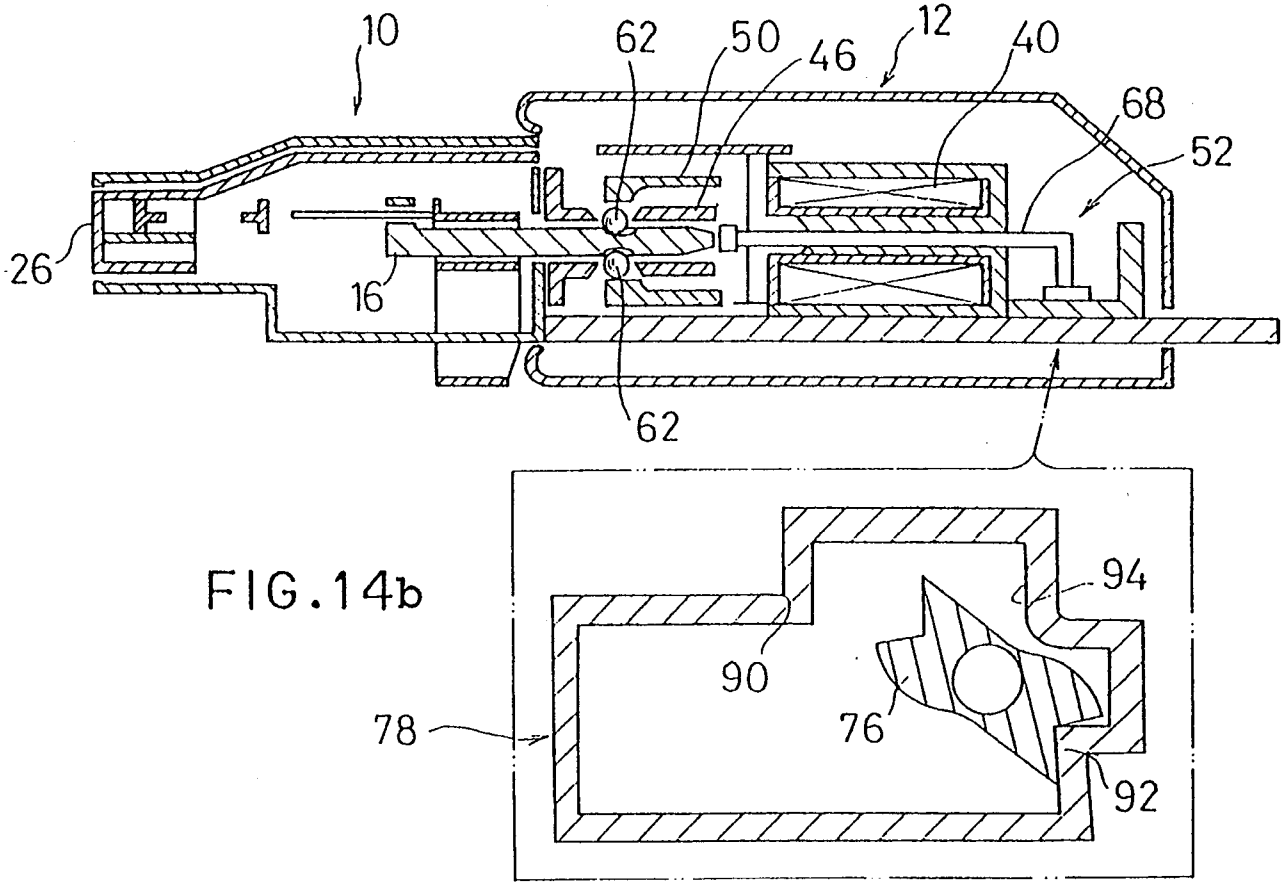
FIG. 14 is a sectional view of the tongue and the buckle, showing the step (3) of engaging the tongue with the buckle.
Figures 15A, 15B:
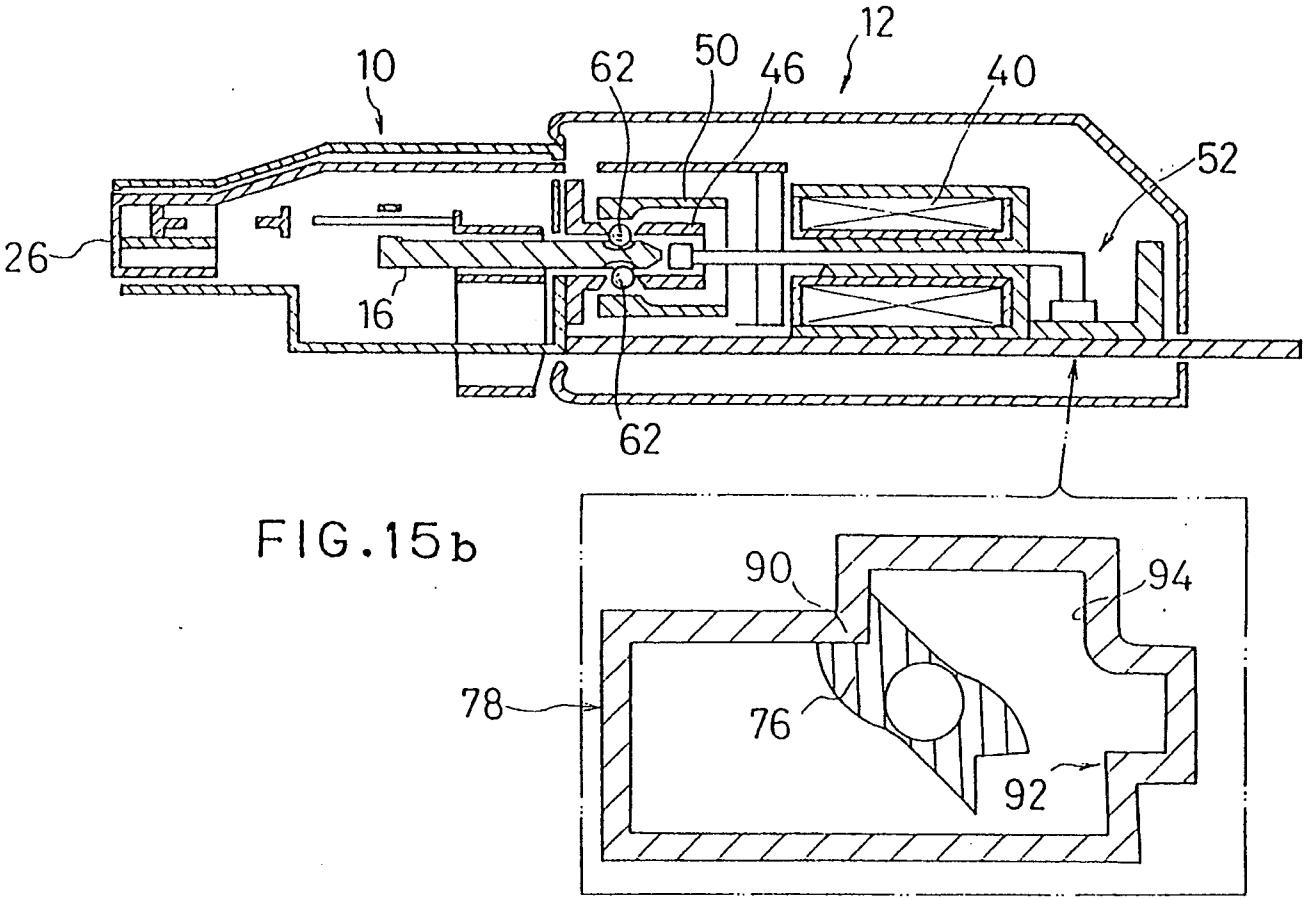
FIG. 15 is a sectional view of the tongue and the buckle, showing the step (4) of engaging the tongue with the buckle.

As is clear from the portions surrounded by the chain lines in FIGS. 12, 14 and 15, the attitude changing portion 92 is composed of a first guide wall 92A which extends approximately orthogonally to the guide groove 78A and a second guide wall 92B which extends in parallel to the guide groove 78A. The attitude changing portion 94 is composed of a guide wall which extends approximately orthogonally to the guide groove 78A. The ratchet wheel stopper portion 90 is constituted by the corner portion of a guide wall which extends from the corner of the case to the middle of the guide groove 78A in parallel with the guide groove 78A so as to face the attitude changing portion 94.

A slit 74B into which the lower end 72A of the fixed plate 72 is inserted is provided on the top surface of the slider 74, as shown in FIGS. 7 and 8, so that the slider 74 is moved with the movement of the fixed plate 72. When the slider 74 is moved, the ratchet wheel 76 moves within the case 78 as shown in FIGS. 12, 14, 15, 16 and 17, and when the notched portion 76C or 76D engages the ratchet wheel stopper portion 90, the ratchet wheel is stopped in the middle of the guide groove 78A.

In FIGS. 12 and 17, the ratchet wheel 76 is situated at its leftmost position. When the ratchet wheel 76 is moved rightward together with the slider 74, the notched portion 76C or 76D comes into contact with the attitude changing portion 92, so that the ratchet wheel 76 rotates about 40 degrees clockwise, as shown in FIG. 14.

When the ratchet wheel 76 in this state is moved leftward together with the slider 74, the notched portion 76D or 76C comes into contact with the ratchet wheel stopper portion 90, as shown in FIG. 15, so that a further leftward movement of the ratchet wheel 76 is checked.

When the ratchet wheel 76 in this state is moved rightward, the ratchet wheel 76 comes into contact with the attitude changing portions 92 and 94, so that the longitudinal axis of the main body of the ratchet wheel 76 is approximately orthogonal to the guide groove 78A, as shown in FIG. 16.

When the ratchet wheel 76 in this state shown in FIG. 16 is moved leftward, the ratchet wheel 76 comes into contact with the ratchet wheel stopper portion 90. Then the ratchet wheel rotates about 90 degrees, and further moves leftward with the attitude shown in FIG. 17.

The structure of the tongue 10 will now be explained with reference to FIGS. 10 and 11. As described above, the tongue plate 16 is inserted into the tongue 10 so as to be freely movable along the length the tongue 10. Springs 100 for urging the tongue plate 16 toward the depth of the tongue 10 are provided. The spring 100 is disposed on the outer periphery of a spring pin 102. The forward end of the spring pin 102 is fixed to a tongue base 104, and the rear end thereof is inserted into an aperture 106 provided in the tongue plate 16. The release button 26 is urged backward by a spring 108 which is provided in contact with the release button 26. The other end of the spring 108 is retained by a bracket 110 projected from the tongue cover 14.

Figure 13:
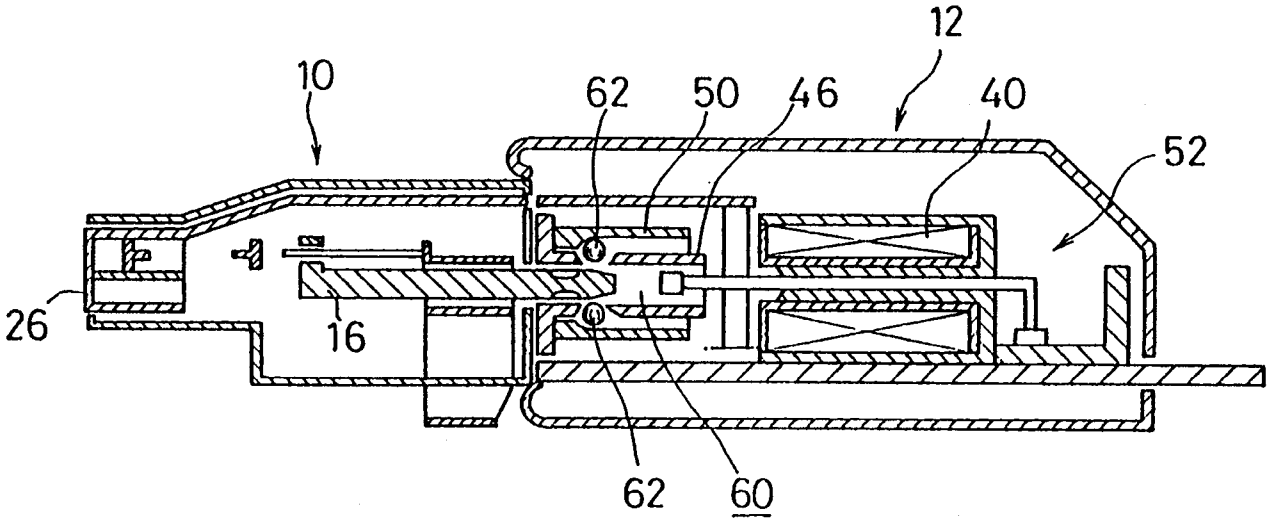
FIG. 13 is a sectional view of the tongue and the buckle, showing the step (2) of engaging the tongue with the buckle.

The operation of the automatic buckling device having the above-described structure will now be explained. FIG. 12 shows the tongue 10 and the buckle 12 in a separated state. In this state, the ratchet wheel 76 is situated at its leftmost position. When the tongue 10 in this state is brought close to the buckle 12, the photoelectric switch 32 detects the approach of the tongue 10 and excites the solenoid 56. The magnet or iron piece 24 is attracted by the strong force, so that the forward end surface of the tongue 10 joins the joint surface of the buckle 12. The forward end of the tongue plate 16 therefore enters the insertion passage 60, as shown in FIG. 13.

When the tongue plate 16 enters the insertion passage 60, the limit switch 66 detects the existence of the tongue plate 16, so that the solenoid 40 is also excited. The tongue plate 16 is drawn deep into the insertion passage 60 by the strong magnetic force, and the tongue plate 16 is deeply inserted into the insertion passage 60, as shown in FIG. 14.

In the state shown in FIG. 14, the forward end of the tongue plate 16 pushes the ejector pin 68, so that the ratchet wheel 76 is moved to the innermost portion of the case 78. The notched portion 76C of the ratchet wheel 76 engages the attitude changing portion 92, and rotates about 40 degrees. With the rightward movement of the ejector pin 68, the link 54 and the ball stopper 50 also move rightward. The ball contacting portion 50A of the ball stopper 50 is thereby brought into close contact with the balls 62 and pushes the balls 62 into the insertion passage 60. The balls 62 are therefore pushed into the recessed portions 18 of the tongue plate 16 and the withdrawal of the balls 62 from the insertion passage 60 is checked.

In other words, the tongue plate 16 is latch-held by the balls 62 in the state shown in FIG. 14. The excitation of the solenoids 40 and 56 is then stopped. By this operation, the tongue plate 16 is withdrawn by the urging force of the springs 100 by the length equivalent to the gap between the ball 62 and the recessed portion 18. The ejector pin 68 also moves toward the entrance of the buckle 12 by the urging forces of the springs 82 and 88, as shown in FIG. 15. In this state, the ratchet wheel 76 engages the ratchet wheel stopper 90, so that a further leftward movement of the ratchet wheel 76 is checked. That is, in the automatic buckling device shown in FIG. 15, the latching operation is completed.

In order to separate the tongue 10 from the buckle 12 in the latched state, the solenoid 40 is excited by a switching operation. The ejector pin 68 is then moved rightward seen in FIG. 15. When the ratchet wheel 76 is moved rightward seen in FIG. 15 while maintaining the angle of inclination of 45 degrees, the ratchet wheel 76 cones into contact with the attitude changing portions 92, 94, so that the longitudinal axis of the main body of the ratchet wheel 76 is approximately orthogonal to the guide groove 78A, as shown in FIG. 16. In this state, the excitation of the solenoid 40 is stopped. The ejector pin 68 is moved leftward seen in FIG. 16 by the operations of the springs 82 and 88 until the automatic buckling device assumes the state shown in FIG. 17. More specifically, the ratchet wheel 76 having the attitude shown in FIG. 16 comes into contact with the ratchet wheel stopper portion 90 in the middle of the leftward movement. At this time, the ratchet wheel 76 rotates 90 degrees clockwise and continues the leftward movement until it assumes the state shown in FIG. 17. When the ratchet wheel 76 is moved to its leftmost position, the ball stopper 50 is also moved to its leftmost position, so that the ball contacting portions 50A of the ball stopper 50 releases the balls 62, as shown in FIG. 17. This state is the same as the state shown in FIG. 3. The balls 62 are then pushed away by the tongue plate 16 so as to be withdrawn from the insertion passage 60. The tongue plate 16 is also withdrawn from the insertion passage 60 by the urging force of the springs 100. As a result, the tongue 10 is separated from the buckle 12, as shown in FIG. 18.

In the process of separating the tongue 10 from the buckle 12 shown in FIGS. 16 and 17, the release button 26 may be pressed in place of exciting the solenoid 40. When the release button 26 is pressed, the forward end portion 26A of the release button 26 pushes the push plate 30 rightward above seen in FIG. 2 and rightward seen in FIG. 16. When the hand is let go off the release button 26, the automatic buckling device in the state shown in FIG. 16 assumes the state shown in FIG. 17, and then the state shown in FIG. 18, so that the tongue 10 is separated from the buckle 12.

As described above, according to the embodiment of an automatic buckling device of the present invention, when the forward portion of the tongue is brought close to the forward end of the buckle 12, the tongue base is automatically drawn into the buckle, thereby assuming the latched state. Accordingly, the occupant is not required to twist the upper half of his body in order to insert the tongue into the buckle. In other words, the buckling operation of the seat belt apparatus is facilitated. In addition, it is possible to separate the tongue from the buckle only by operating the switch. That is, the unbuckling operation of the seat belt apparatus is also facilitated.

What is claimed is:

1. An automatic buckling device comprising:

a tongue attached to a seat belt; and a buckle for latching said tongue;

said tongue including a cover case, a tongue plate which can project from the forward end of said cover case, a spring for urging said tongue plate in the direction in which said tongue plate is withdrawn into said cover case, and a recessed portion provided on the surface of said tongue plate at the forward end thereof so as to engage a ball; and said buckle including an insertion passage into which said tongue plate is inserted, a solenoid for drawing said tongue into said buckle, a ball which is engageable with said recessed portion of said tongue plate which is inserted into said insertion passage, a ball holder for holding only a part of said ball so that said ball can enter said insertion passage, a ball stopper which moves to a latch-holding position at which said ball stopper comes into close contact with said ball when a part of said ball enters said insertion passage so as to check the withdrawal of said ball from said insertion passage, and a stopper moving mechanism for moving said ball stopper to said latch-holding position when said tongue plate has completely entered said insertion passage and moving said ball stopper from said latch-holding position by remote switching control in order to separate said tongue from said buckle.

2. An automatic buckling device according to claim 1, wherein said stopper moving mechanism is disposed in said buckle in the extension of said insertion passage, and includes an ejector pin which is movable along the length of said buckle when said tongue plate pushes said ejector pin or when said solenoid is excited, a return spring for urging said ejector pin in the direction in which said tongue plate is withdrawn, a link for connecting said ejector pin with said ball stopper, a stopping means which is connected to said ejector pin and said link and which can be stopped at two positions in the direction in which said ejector pin and said link move;

said two positions being a first position which is the limit of movement of said ejector pin and said link in the direction in which said tongue plate is withdrawn, and a second position which is located closer to the depth of said buckle.

3. An automatic buckling device according to claim 2, wherein said stopping means includes a slider which is connected with said ejector pin and said link and which can be advanced or withdrawn together with said ejector pin, a ratchet wheel supported by said slider through a rotary shaft, and a case for holding said ratchet wheel;

said ratchet wheel being composed of a main body having a longer axis and a shorter axis, and substantially V-shaped notched portions on both shorter sides thereof, and said rotary shaft projecting at the intersection of said lower and shorter axes;

said case including a guide groove which extends in parallel with the longitudinal axis of said ejector pin and which engages said rotary shaft, a ratchet wheel stopper portion disposed beside said guide groove at a middle of the length of said guide groove, and a ratchet attitude changing portion which is provided in the extension of said guide groove closer to the depth of said buckle;

said ratchet wheel stopper portion allowing said ratchet wheel to pass by when the longitudinal axis of said main body of said ratchet wheel is parallel to said guide groove, while being engageable with one of said notched portions of said ratchet wheel when the longitudinal axis of said main body is oblique to said guide groove and said ratchet wheel moves directed by said one of notched portions in the direction in which said tongue plate is withdrawn; and said ratchet attitude changing portion including a guide wall which engages one of said notched portions directing said ratchet wheel and rotates said ratchet wheel so that the longitudinal axis of said main body intersects the longitudinal axis of said guide groove and the other one of said notched portions is directed toward said ratchet wheel stopper portion when said ratchet wheel approaches said ratchet attitude changing portion with the longitudinal axis of said main body in parallel with said guide groove, and which comes into contact with the side surface of said main body on the side closer to said guide wall and rotates said ratchet wheel so that the longitudinal axis of said main body is approximately orthogonal to the longitudinal axis of said guide groove when said ratchet wheel approaches said ratchet attitude changing portion with the longitudinal axis of said main body oblique to the longitudinal axis of said guide groove.

4. An automatic buckling device according to claim 3, wherein said ratchet wheel attitude changing portion includes a guide wall which extends approximately orthogonally to the longitudinal axis of said guide groove, a first ratchet wheel rotation stopping wall which extends approximately in parallel with said guide groove, and a second ratchet wheel rotation stopping wall which comes into contact with the rear end side of said ratchet wheel when said ratchet wheel is rotated so that the longitudinal axis of said main body of said ratchet wheel is approximately orthogonal to the longitudinal axis of said guide groove.

5. An automatic buckling device according to claim 1, wherein, said tongue plate is latch-held by exciting said solenoid, dawning said tongue plate into said insertion passage by said solenoid, fitting said ball in said recessed portion and checking the withdrawal of said ball by said ball stopper when said tongue is brought close to said buckle, while said tongue plate is withdrawn from said insertion passage by exciting said solenoid again and moving said ball stopper away from said latch-holding position so as to withdraw said ball from said insertion passage.

* * * * *